US009254901B2

(12) United States Patent
Gill

(10) Patent No.: US 9,254,901 B2
(45) Date of Patent: Feb. 9, 2016

(54) PERSONAL BOAT CARRYING APPARATUS

(71) Applicant: Scott Gill, Toronto (CA)

(72) Inventor: Scott Gill, Toronto (CA)

( * ) Notice: Subject to any disclaimer, the term of this patent is extended or adjusted under 35 U.S.C. 154(b) by 0 days.

(21) Appl. No.: 14/483,757

(22) Filed: Sep. 11, 2014

(65) Prior Publication Data

US 2015/0076191 A1 Mar. 19, 2015

Related U.S. Application Data

(60) Provisional application No. 61/879,897, filed on Sep. 19, 2013.

(51) Int. Cl.

| | |
|---|---|
| ***B63B 13/00*** | (2006.01) |
| ***A45F 3/15*** | (2006.01) |
| ***B63C 13/00*** | (2006.01) |
| ***B63B 35/79*** | (2006.01) |
| *B63B 35/71* | (2006.01) |

(52) U.S. Cl.

CPC ..... *B63C 13/00* (2013.01); *B63B 35/7946* (2013.01); *A45F 3/15* (2013.01); *B63B 35/71* (2013.01); *B63B 2035/715* (2013.01)

(58) Field of Classification Search

CPC ..... A45F 3/15; B63C 13/00; F16M 13/04
USPC ..... 224/265, 266, 907
See application file for complete search history.

(56) References Cited

U.S. PATENT DOCUMENTS

| | | | | |
|---|---|---|---|---|
| 966,562 | A * | 8/1910 | Knoerzer | 224/266 |
| 3,259,284 | A * | 7/1966 | Olson | 294/142 |
| 3,734,367 | A * | 5/1973 | Jackson | 224/262 |
| 4,091,975 | A * | 5/1978 | Russell, Jr. | 224/265 |
| 4,234,113 | A * | 11/1980 | Nalvarian | 294/142 |
| 4,236,267 | A * | 12/1980 | Lewis et al. | 114/347 |
| 4,768,459 | A * | 9/1988 | Cerkvenik et al. | 114/363 |
| 4,804,123 | A * | 2/1989 | French | 224/266 |

(Continued)

FOREIGN PATENT DOCUMENTS

| | | | |
|---|---|---|---|
| CA | 2205980 | A1 * | 11/1998 |
| CA | 2241864 | A1 * | 12/1999 |

OTHER PUBLICATIONS

Carry Yak, Carry Yak | Facebook, online: https://www.facebook.com/carryyak (accessed on Oct. 6, 2014), 2014, 5 pages.

(Continued)

*Primary Examiner* — Justin Larson
(74) *Attorney, Agent, or Firm* — Heer Law; Christopher D. Heer

(57) ABSTRACT

A personal boat carrying apparatus is provided for supporting a kayak or similar boat on a user during a portage to make portaging a kayak easier and less uncomfortable. The apparatus is lightweight but durable and has a body with a curved and arched center portion for resting on the shoulders of a user carrying the kayak, and two opposite body ends. Each body end has a support arm which pivots from a closed position to one or more open positions. The pivoting support arm provides multiple open positions to allow the apparatus to support kayaks and similar boats of different widths and configurations. Each support may have a swiveling bracket for engaging the gunwale of the cockpit of the kayak or similar boat. When the support arms are in the closed position, the apparatus may be compactly stored in the boat or elsewhere.

20 Claims, 9 Drawing Sheets

(56) References Cited

U.S. PATENT DOCUMENTS

| | | | | | |
|---|---|---|---|---|---|
| 4,850,296 | A * | 7/1989 | Slanker et al. | 114/343 |
| 4,871,102 | A * | 10/1989 | Wickersham | 224/191 |
| 4,874,120 | A * | 10/1989 | Paton et al. | 224/266 |
| 4,963,904 | A * | 10/1990 | Lee | 396/423 |
| 5,127,356 | A * | 7/1992 | Schenkenberger | 114/347 |
| 5,207,364 | A * | 5/1993 | Johnson | 224/264 |
| 5,495,968 | A * | 3/1996 | Miller | 224/266 |
| 5,577,457 | A * | 11/1996 | Nichols, Jr. | 114/343 |
| 5,740,755 | A * | 4/1998 | Nichols, Jr. | 114/343 |
| 5,875,946 | A * | 3/1999 | Knudsen | 224/262 |
| 6,019,263 | A * | 2/2000 | Palmer | 224/261 |
| 6,189,752 | B1 * | 2/2001 | Perry | 224/264 |
| D476,942 | S * | 7/2003 | Duval et al. | D12/317 |
| 6,685,069 | B2 * | 2/2004 | Ladd | 224/265 |
| 7,562,635 | B1 * | 7/2009 | Morris | 114/347 |
| 7,681,766 | B2 * | 3/2010 | Harrison et al. | 224/265 |
| 7,789,198 | B2 * | 9/2010 | Myers | 182/129 |
| 8,479,959 | B2 * | 7/2013 | Evans et al. | 224/265 |
| 2002/0030073 | A1 * | 3/2002 | Duval et al. | 224/266 |
| 2015/0076191 | A1 * | 3/2015 | Gill | 224/191 |

OTHER PUBLICATIONS

Kirk Scuba Gear, Carry Yak, online: http://kirkscubagear.com/carry_yak_-_hands_free_kayak_carrying (accessed on Oct. 6, 2014), 2013, 3 pages.

* cited by examiner

PERSONAL BOAT CARRYING APPARATUS

FIELD OF THE INVENTION

The present specification relates generally to boating accessories and more specifically relates to a personal boat carrying apparatus for assisting a person carry a kayak or similar boat such as during a portage.

BACKGROUND OF THE INVENTION

Kayaks and similar types of boats are designed for use in bodies of water and are cumbersome to carry over land. Various wheeled trolleys and carts are available to assist users transport their boat to water without having to carry it on their shoulders. However, such wheeled devices are only suitable on substantially even terrain such as paved surfaces. In rougher terrain, the user must portage. Portaging refers to the practice of carrying one's boat over land, for example, to avoid an obstacle in a river or to carry one's boat from one body of water to another.

A typical kayak weighs about 45 to 55 pounds (excluding any gear of the user) and has an open space on the top of the boat called a cockpit in which the kayaker sits to navigate the kayak when it is in water. A fisherman's kayak is similar to a typical kayak except that the cockpit area is much larger to accommodate fishing gear. The kayak cockpit of both types of kayak is surrounded by a gunwale (which refers to the top edge of the side of the boat), but there is no aspect of the cockpit that is designed to assist the user carry the kayak over land.

Two people may carry a kayak over land using the handles at the front and back of the boat. However, a second person may not be available or convenient in every circumstance. Where no second person is available to assist with carrying a kayak, a kayaker would typically flip the kayak over and put it on one of his or her shoulders. Carrying the kayak in this fashion may be unstable and fails to evenly distribute the weight of the boat across the kayaker's musculature. Carrying a kayak in this manner is also tiring and uncomfortable for the portager, especially over long durations.

Accordingly, there remains a need for improvements in the art.

SUMMARY OF THE INVENTION

In accordance with an aspect of the invention, there is provided a personal boat carrying apparatus that has a closed position in which the apparatus may be compactly stored or shipped and one or more open positions of which at least one is capable of engaging the boat in a manner to assist a person support the boat on top of their shoulders or upper back or both. The boat carrying apparatus of the present invention may make portaging a kayak or similar boat easier and less tiring and uncomfortable for the portager. Further, its collapsible configuration may make it both quick to deploy and to remove and store in the boat once the portage is complete. The compact profile of apparatus in the closed position may also make it less prone to being damaged while on a boating trip.

According to an embodiment of the invention, the present invention provides a personal kayak carrying apparatus for supporting a kayak on a user, the kayak carrying apparatus comprising: a body having a first body end, a second body end opposite the first body end, and a center portion between the first body end and the second body end, the center portion configured to rest on the user; a first support arm which pivots about a first hinge proximate to the first body end, the first support arm pivoting between a closed position and one or more open positions, wherein the first support arm is configured to engage a first location of the boat in at least one of the open positions; and a second support arm which pivots about a second hinge proximate to the second body end, the second support arm pivoting between a closed position and one or more open positions, wherein the second support arm is configured to engage a second location of the boat in at least one of the open positions.

According to a further embodiment, the present invention provides a personal boat carrying apparatus for supporting a boat on a user, the boat carrying apparatus comprising: a body having a first body end, a second body end opposite the first body end, and a center portion between the first body end and the second body end, the center portion configured to rest on the user; a first support disposed proximate to the first body end, the first support configurable to engage a first location of the boat; and a second support disposed proximate to the second body end, the second support configurable to engage a second location of the boat.

According to a further embodiment, the present invention provides a method of carrying a boat, the method comprising: engaging a first location of the boat using a first support; engaging a second location of the boat using a second support, wherein the first support and the second support are disposed at opposite ends of a body of an apparatus; and resting a center portion of the body on a person, such that the person can carry the boat.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicate like or corresponding elements in the drawings.

DETAILED DESCRIPTION OF THE EMBODIMENTS

Figure 1:
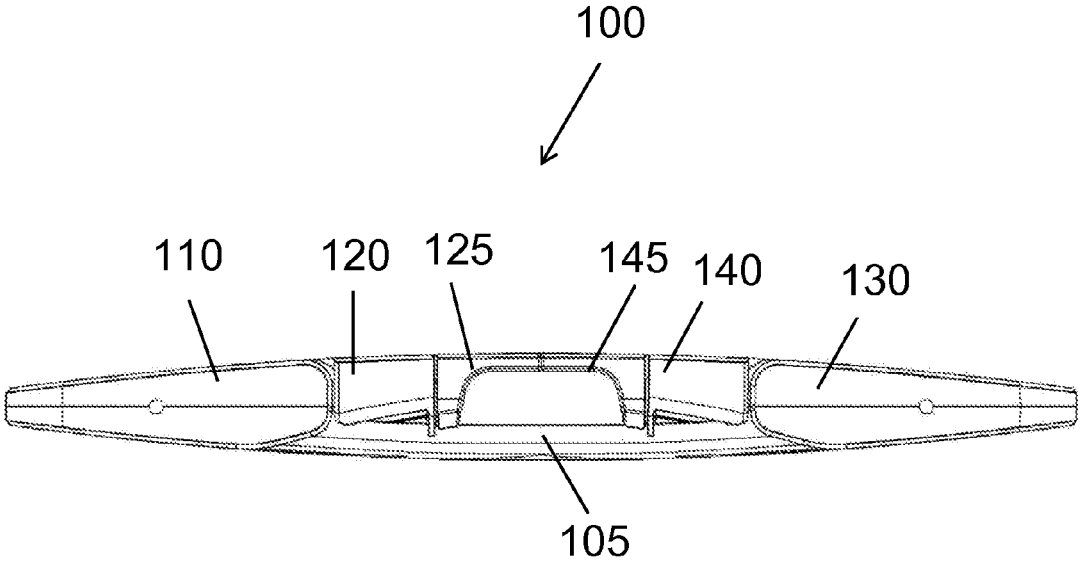
FIG. 1 is a front view of a personal boat carrying apparatus in a closed position according to an embodiment.
Figure 2:
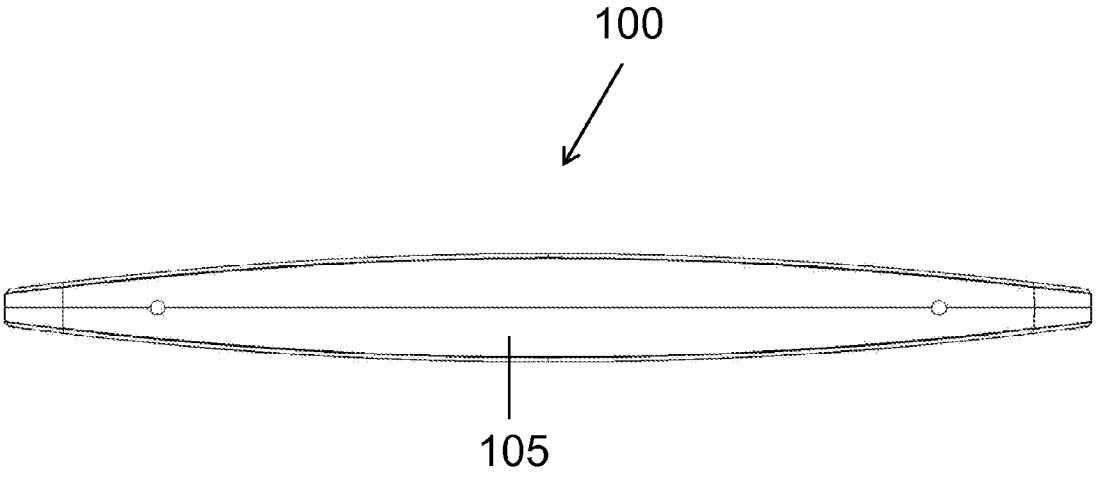
FIG. 2 is a back view of the personal boat carrying apparatus of FIG. 1 in the closed position.
Figure 3:
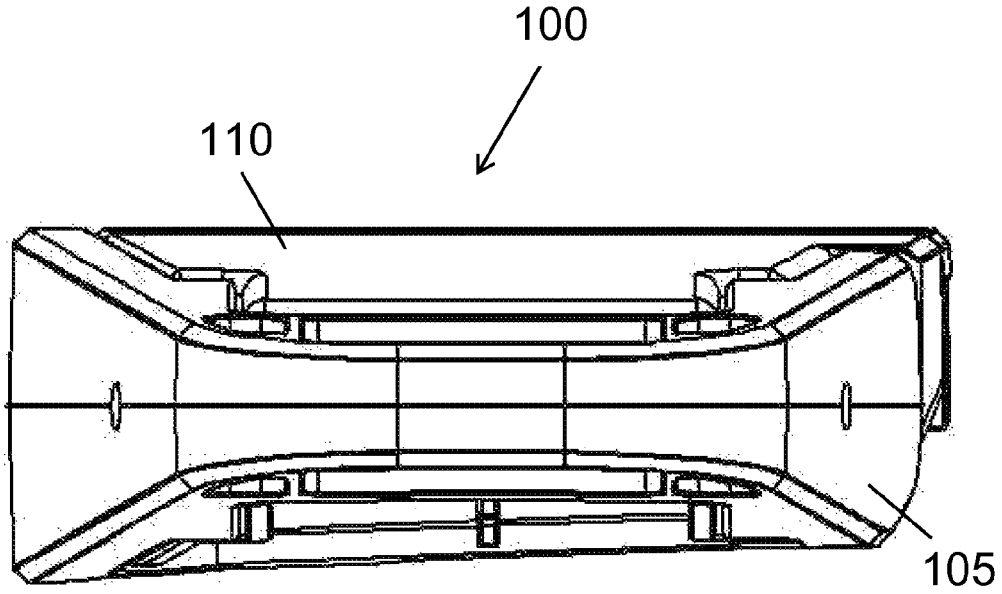
FIG. 3 is a left view of the personal boat carrying apparatus of FIG. 1 in the closed position.
Figure 4:
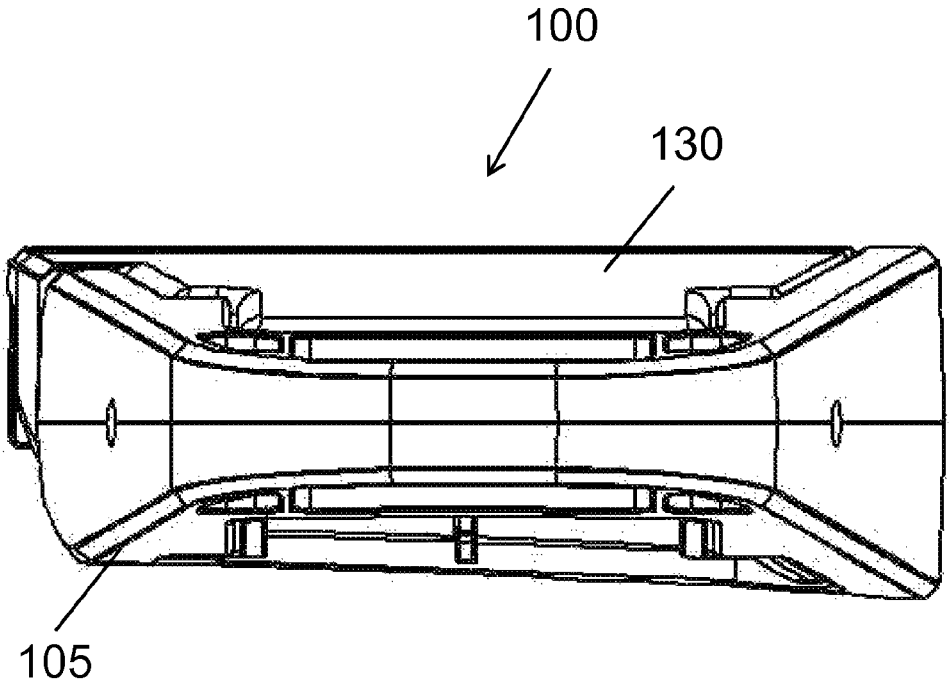
FIG. 4 is a right view of the personal boat carrying apparatus of FIG. 1 in the closed position.
Figure 5:
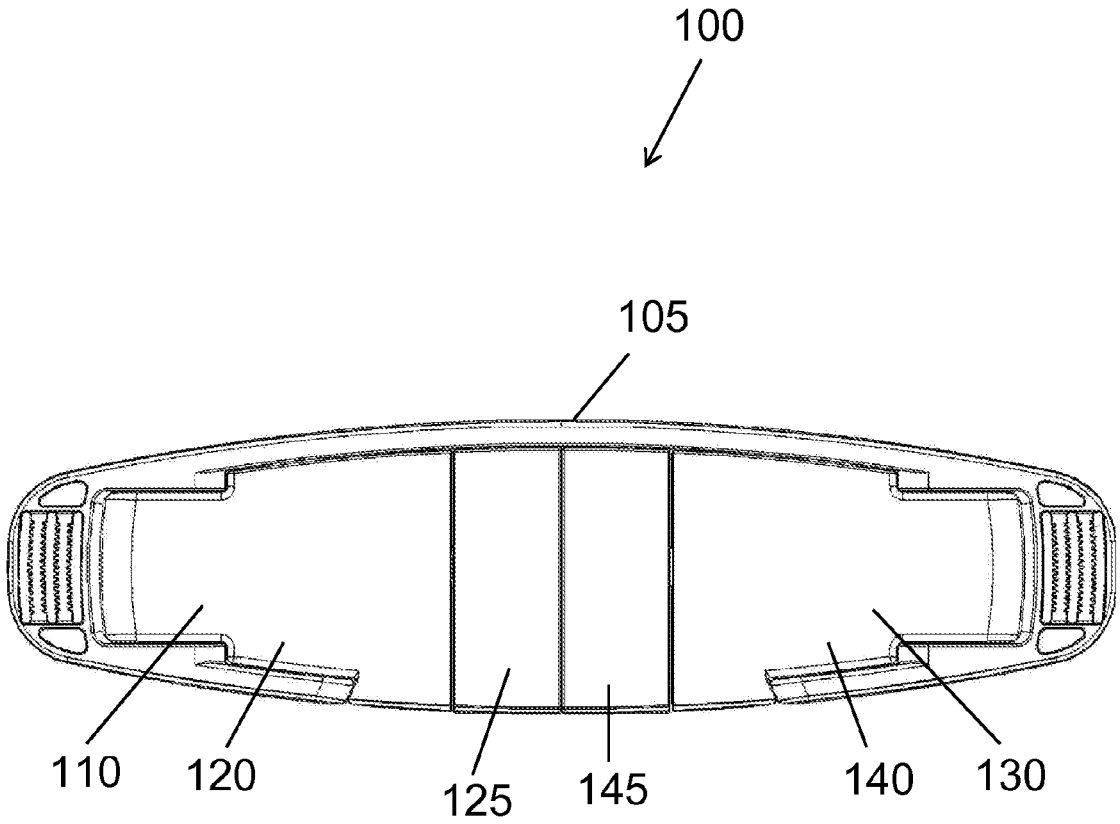
FIG. 5 is a top view of the personal boat carrying apparatus of FIG. 1 in the closed position.
Figure 6:
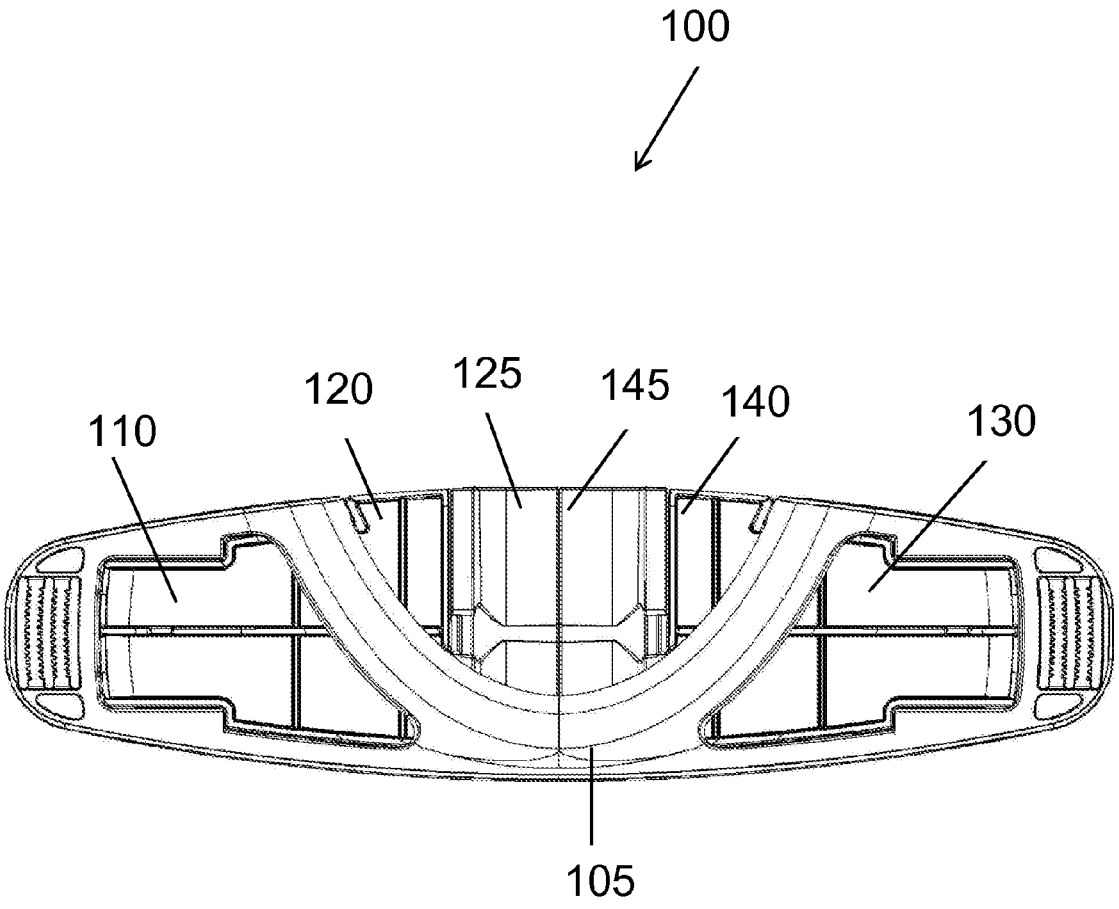
FIG. 6 is a bottom view of the personal boat carrying apparatus of FIG. 1 in the closed position.

According to an embodiment as shown in FIGS. 1 to 11, a personal boat carrying apparatus such as boat carrying apparatus 100 is generally configured to allow a user, namely a human, to support a boat, such as a kayak or fisherman's kayak or similar boat, above a surface. The boat carrying apparatus 100 may better distribute the weight of the boat over the user's musculature (as opposed to the boat being carried over one shoulder only) so that the user may better balance the boat while it is being carried as well as reduce the discomfort of carrying the boat over long durations. The boat carrying apparatus 100 may be used to assist the user to carry the boat over almost any surface capable of being traversed on foot with less difficulty and less discomfort than carrying the boat without the boat carrying apparatus 100. As a preliminary matter, it should also be noted that the boat carrying apparatus of the present invention discussed herein may be embodied in configurations other than what is shown in FIGS. 1 to 11 and used with other types of boats that may be carried by a person as long as there is a way for the first and second supports to engage the boat in a manner that allows the boat to be carried as described more particularly below.

According to an embodiment as shown in FIGS. 1 to 11, the boat carrying apparatus 100 may include a body 105, a first support 110 and a second support 130. The body 105 may be configured to rest on the user carrying the boat. The body 105 may have a center portion designed to rest on the user such that the body 105 is substantially evenly balanced on the shoulders of the user. According to an embodiment, the center portion of the body 105 may be curved in a contour around the neck of the user and arched higher towards the center so as to cause the apparatus to better rest across the upper back and shoulders of the user and provide increased comfort while carrying a boat. According to other embodiments, the center portion of the body 105 may be U-shaped, or may include a wider portion with an opening to accommodate the neck, or may be straight. According to yet further embodiments, the boat carrying apparatus 100 may be modified to distribute the weight of the boat onto another portion of the user's body such as the head, back, waist, or a combination of body parts, which may serve to reduce localized stress on the user. According to an embodiment, the boat carrying apparatus 100 may secure to the user such as by use of a harness so that the boat may be carried hands-free. According to an embodiment, the body 105 may include hooks on the outside of the body 105 to carry items and personal effects such as key chains or gear to portage. Carrying gear off of hooks on the body 105 of boat carrying apparatus 100 may make the boat easier to carry than when gear is stowed in the boat as gear stowed in the boat may affect the center of gravity of the boat (including the stowed gear) and may increase the forces necessary to stabilize the boat while being carried.

The body 105 may be constructed from materials which provide the mechanical strength and rigidity for supporting the boat on the user. According to an embodiment, the body 105 may be made of plastic, such as injection molded plastic. In other embodiments, the body 105 may include wood, aluminum, steel, plastics or composites, or a combination of suitable materials.

Figure 7:
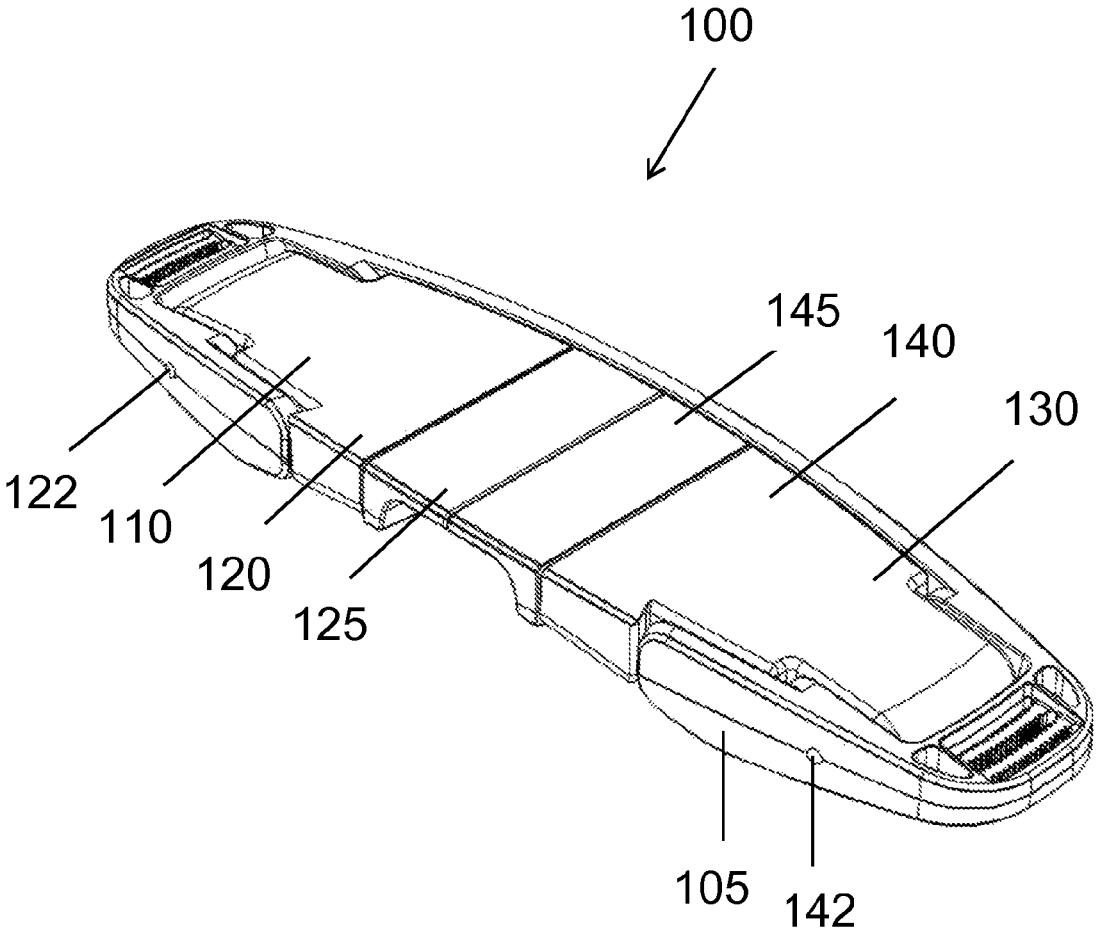
FIG. 7 is a perspective view of the personal boat carrying apparatus of FIG. 1 in the closed position.
Figure 8:
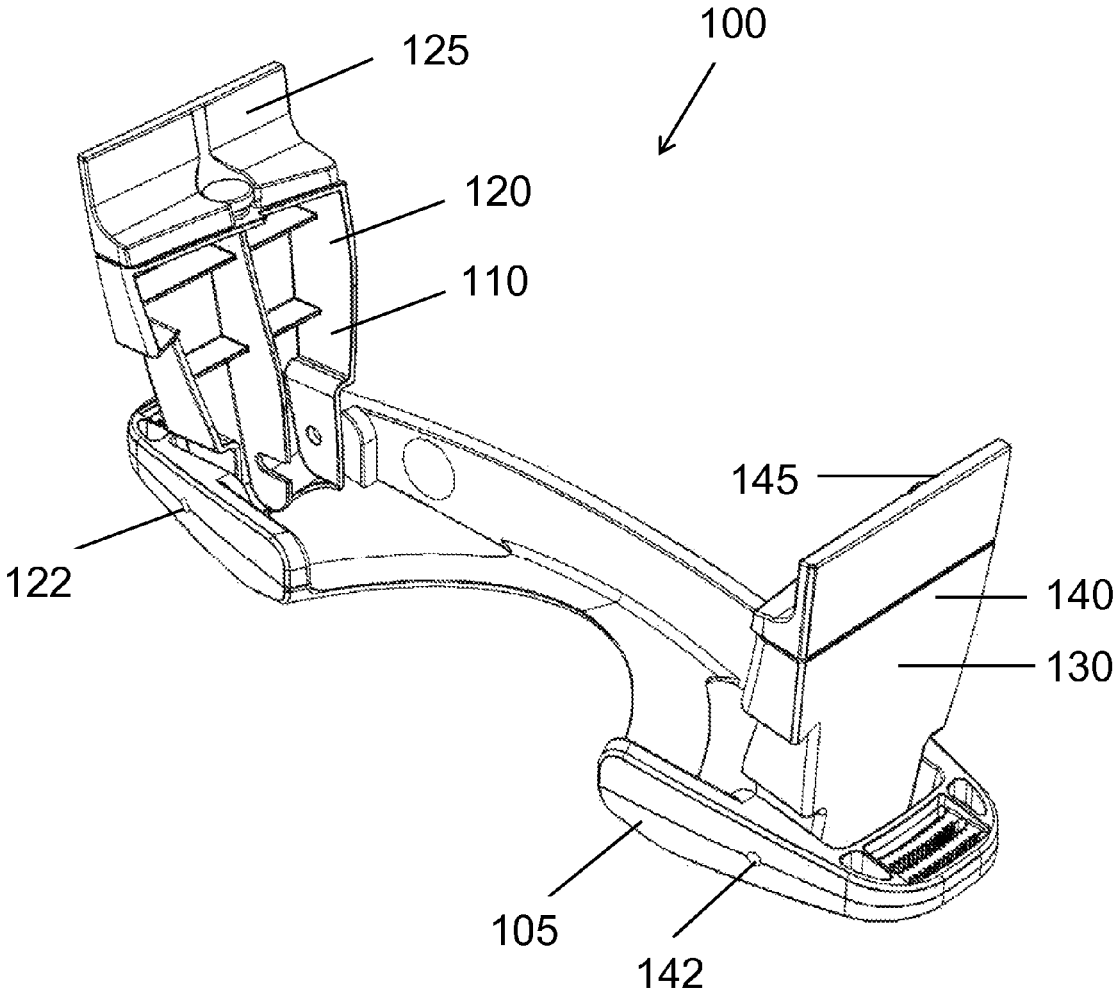
FIG. 8 is a perspective view of the personal boat carrying apparatus of FIG. 1 in an open position.
Figure 9:
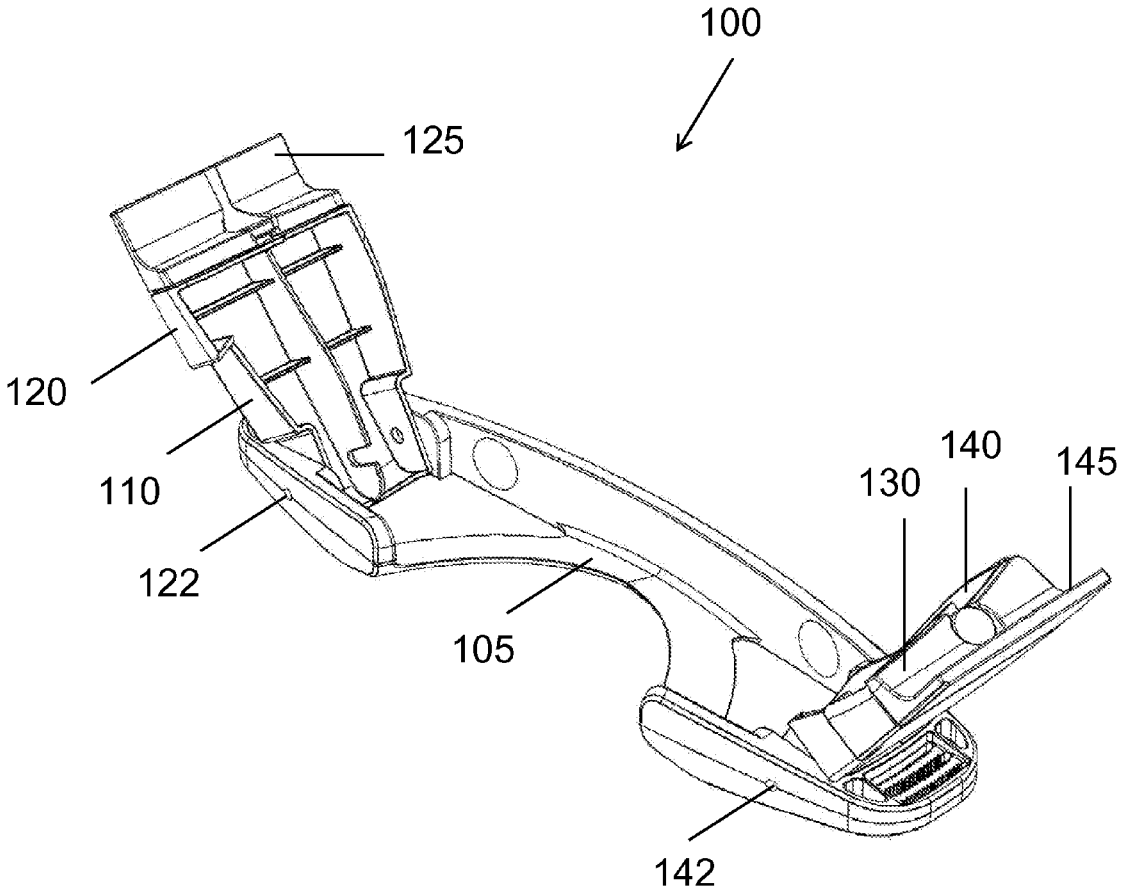
FIG. 9 is a perspective view of a personal boat carrying apparatus of FIG. 1 in a further open position.

According to an embodiment as shown in FIGS. 1 to 11, the first support 110 may be disposed proximate to a first end of the body 105 and may be configured to engage a first location of the boat. According to an embodiment, the first support 110 may comprise a first support arm 120 extending from the body 105, and the first support arm 120 may pivot from a first hinge 122 connected to the body 105. According to an embodiment as shown in FIGS. 8 and 9, the first support arm 120 may pivot to more than one open position which may allow the boat carrying apparatus to be used with different sizes and configurations of boats. According to an embodiment as shown in FIGS. 7 to 9, at least one of the open positions (as shown in FIG. 9) may include pivoting the first support arm 120 more than 90 degrees from the closed position shown in FIG. 7. The boat carrying apparatus 100 may include a strap 170, as described further below, that may be attached to the body 105 and wrapped around the boat to assist in securing the boat to the boat carrying apparatus 100 which may reduce the likelihood of the boat shifting or disengaging off of the boat carrying apparatus 100 while the boat is being carried. According to one particular embodiment built as a prototype, the one or more open positions may span from about 14.73 inches to about 21.04 inches as measured from the first support bracket to the second support bracket.

According to other embodiments, the first support 110 may be connected to the body 105 using a nail, a screw, a clamping mechanism, pin or peg, or a combination thereof. In a yet further embodiment, the first support 110 may be integrally formed from the body 105.

The first support 110 may be constructed from materials which provide the mechanical strength and rigidity for supporting the boat on the user. According to an embodiment, the first support 110 may be made from plastic, such as through injection molding. According to other embodiments, the first support 110 may include wood, aluminum, steel, plastics or composites, or a combination of suitable materials.

According to an embodiment as shown in FIGS. 1 to 11, the first support 110 further comprises a first support bracket 125 disposed on the first support arm 120. The first support bracket 125 may be configured to engage a complimentary structure of the boat such as a gunwale 65 (also referred to as a gunnel, i.e. the top edge of the side of a boat) of the boat. For example, where the boat is a kayak, the first support bracket 125 may be configured to receive the gunwale 65 of the kayak's cockpit. According to an embodiment, the first support bracket 125 may swivel about a point at the center of its attachment with the first support arm 120 to permit the first support bracket 145 to rotate to an angle that may better receive the gunwale of the boat.

According to an embodiment as shown in FIGS. 1 to 11, a second support 130 may be disposed proximate to a second end of the body 105 opposite of the end where the first support 110 is disposed. The second support 130 may be similar in configuration to the first support 110 and may be configured to engage a second location of the boat. According to an embodiment, the second support 130 may be a mirror image of the first support 110.

According to an embodiment as shown in FIGS. 1 to 11, the second support 130 may comprise a second support arm 140 extending from the body 105, and the second support arm 140 may pivot from a second hinge 142 connected to the body 105. According to other embodiments, the second support 130 may be connected to the body 105 using a nail, a screw, a clamping mechanism, pin or peg, or a combination thereof. In a yet further embodiment, the second support 130 may be integrally formed from the body 105.

The second support 130 may be constructed from materials which provide the mechanical strength and rigidity for supporting the boat on the user such as those materials discussed above in connection with the first support 110.

According to the embodiment as shown in FIGS. 1 to 11, the second support 130 further comprises a second support bracket 145 disposed on the second support arm 140. The second support bracket 145 may be configured to engage with a complimentary structure of the boat such as a gunwale 65 of the boat. According to an embodiment, the second support bracket 145 may be configured to engage with a location along the gunwale 65 of a cockpit. According to an embodiment, the second support bracket 145 may swivel about a point on at the center of its attachment with the second support arm 140 to permit the second support bracket 145 to rotate to an angle that may better receive the gunwale of the boat. According to an embodiment, the first support bracket 125 and the second support bracket 145 may be configured to engage the boat at locations substantially opposite each other on the gunwale 65 of the cockpit of the boat to provide balanced support of the boat and to distribute the weight of the boat across the boat carrying apparatus 100.

According to an embodiment, dimples may be set in the body 105 to aid in retaining the support arms 120 and 140 in the closed position as shown in FIG. 7. The dimples may provide enough resistance to prevent the support arms from swinging open in absence of the exercise of deliberate force by the user. Similarly, dimples may be employed to help retain the brackets 125 and 145 in their neutral orientation in the absence of a suitable threshold amount of force being exercised to reorient them.

According to further embodiments, other attachment points may support the boat and the locations of where the first support 110 and the second support 130 engage the boat may be modified such that the first and second support brackets 125 and 145 are not directly opposite each other. Furthermore, first support 110 and second support 130 may also be configured to engage other types of boats with different connection mechanisms. According to a further embodiment, the boat carrying apparatus may comprise more than two supports.

In further embodiments of the boat carrying apparatus 100, one or both of the first support bracket 125 and the second support bracket 145 may be omitted and another mechanism for securing the support to a location on the boat may be used. For example, one or both supports may include a quick release mechanism configured to mate with a complimentary mechanism disposed on the boat, or one or both supports may be configured to be directly secured by employing a notch or other connection mechanism.

Figure 10:
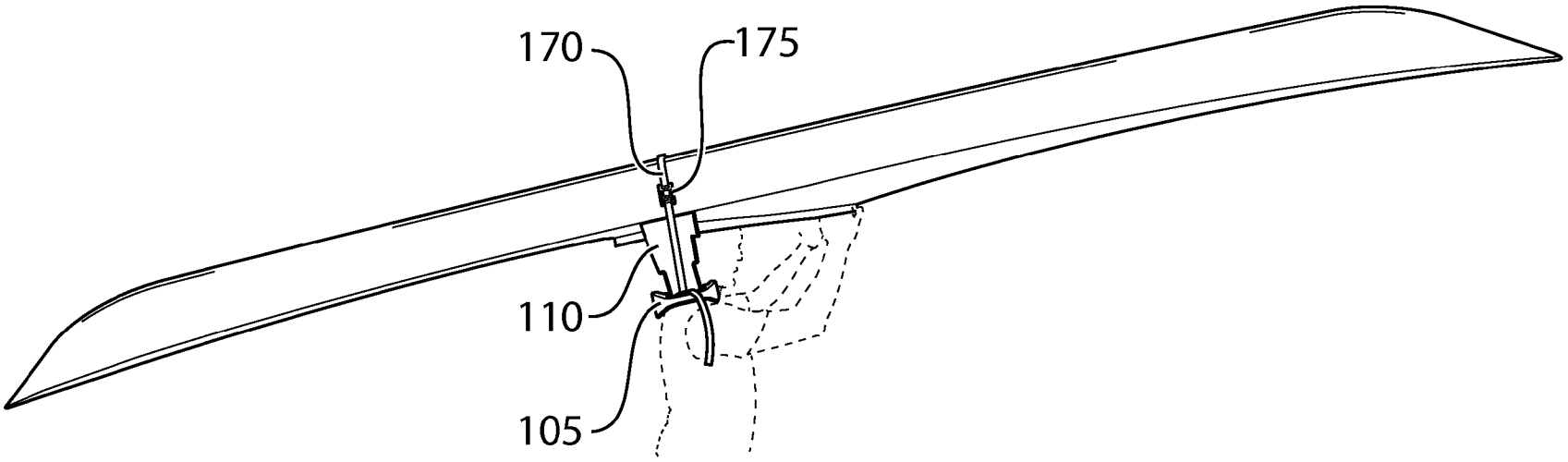
FIG. 10 is a side view of a personal boat carrying apparatus in use by a user carrying a kayak.

In use, as may be seen with reference to FIG. 10, the boat carrying apparatus 100 according to the embodiments described herein may be configured to engage a first location of the boat using the first support 110 and a second location of the boat using the second support 130. The center portion of the body 105 may then be rested on the user such that the weight of the boat carrying apparatus 100 and the boat may be supported by the user. A particular embodiment built by the inventor was capable of handling loads of at least 120 pounds.

Figure 11:
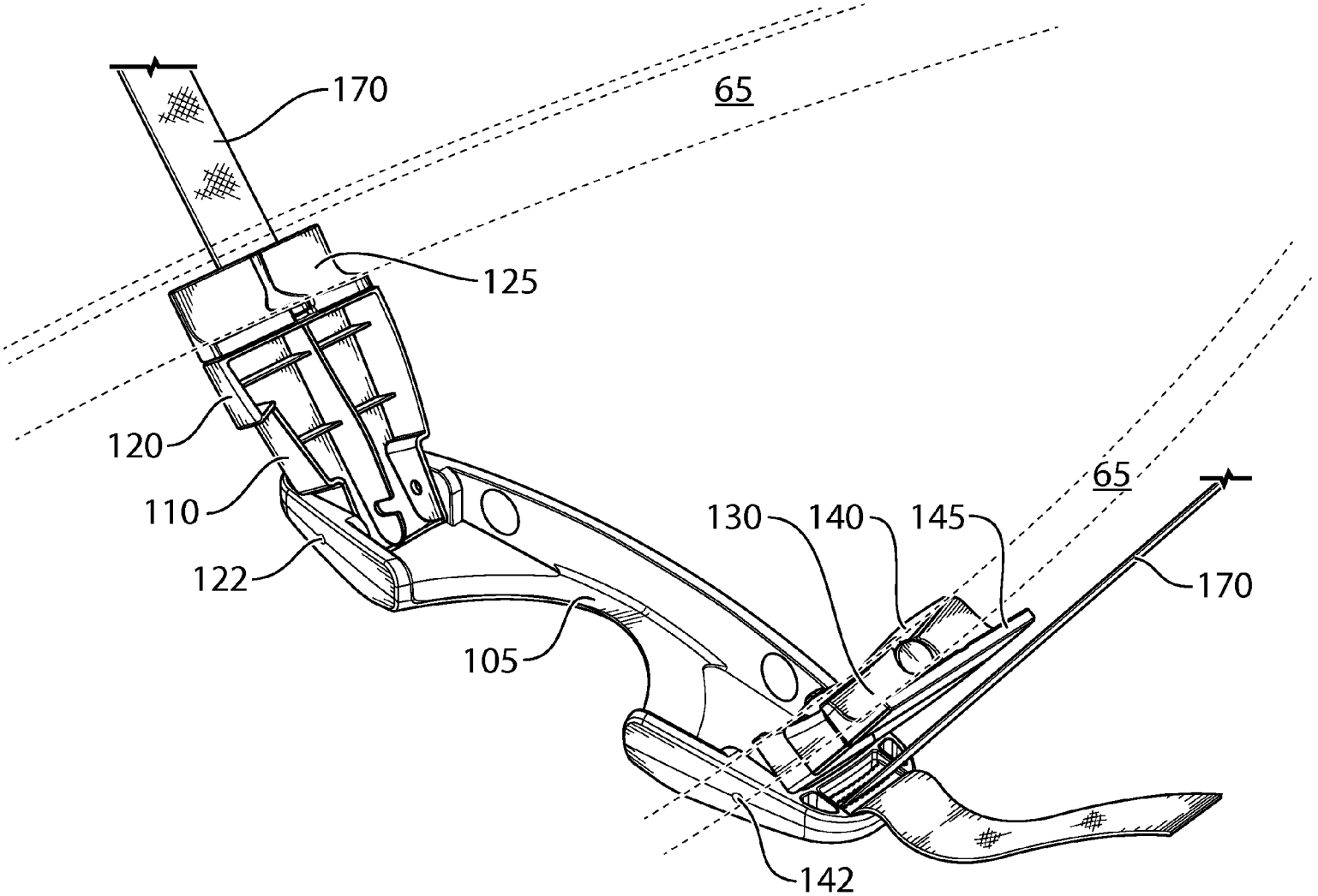
FIG. 11 is a perspective view of the personal boat carrying apparatus of FIG. 10, in which the gunwale of the kayak is shown in stippled lines.

According to an embodiment as shown in FIGS. 10 and 11, the boat carrying apparatus 100 may comprise a securing mechanism such as a strap 170 that may be used to further secure the boat on the first support 110 and the second support 130 of the boat carrying apparatus 100. Use of the strap 170 may reduce the likelihood of the boat shifting or disengaging off of the brackets 125 and 145 while the boat is being carried by the user. The strap 170 may be made from any suitable material which has sufficient strength to secure the boat on the first support 110 and the second support 130, including nylon, plastics, metal, and cloth. Considerations to be taken in account when selecting the material for the strap 170 may include the weight of the boat, the specific design of the boat carrying apparatus, and manufacturing costs.

According to an embodiment, opposite ends of the strap 170 may be connected to opposite ends of the body 105, respectively, such that the strap 170 is configured to wrap around the boat. The mechanism for connecting the strap 170 to the ends of the body 105 may include any mechanism capable of securely holding the strap in place, such as hook and loop fasteners, nails, screws, or nuts and bolts that pass through the strap 170, clamping mechanisms, adhesives, or a combination thereof.

According to an embodiment, the length of the strap 170 between the attachment points may be adjusted from a loose to a tightened position so as to secure boats of different shapes and sizes to the boat carrying apparatus 100. According to an embodiment, a buckle 175 disposed between the attachment points of the strap 170 may be used in providing this length adjustment. In other embodiments, the length may be adjusted using a plurality of buckles or the strap 170 may be configured to connect to the body 105 using an adjustable buckle at one or both of the attachment points. In yet another embodiment, the strap 170 may comprise an elastic material such as rubber or a synthetic polymer so that the length may be adjusted using the natural elasticity of the strap 170. In a yet further embodiment of the strap 170, it may be of a fixed length and designed to be used with a specific size and configuration of boat.

According to further embodiments, the securing mechanism may be any other suitable securing mechanism such as a clamp or rope. According to certain of such embodiments, the securing mechanism need not wrap around the entire boat and may engage a portion of the sides or bottom of the boat.

Moreover, the embodiments discussed above may include padding such as neoprene padding (not shown) on the curved center of the body 105 configured to cushion the body 105 against the user which may increase comfort. Furthermore, padding such as a rubber adhesive may be used on the brackets 125 and 145 to protect the boat against scratches. It is to be appreciated that the padding is not limited to any specific type of material and generally includes soft materials.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A personal kayak carrying apparatus for supporting a kayak on a user, the kayak carrying apparatus comprising:

a body having a first body end, a second body end opposite the first body end, and a center portion between the first body end and the second body end, the center portion configured to rest on the user;

a first support arm which pivots about a first hinge proximate to the first body end, the first support arm pivoting between a closed position wherein the first support arm substantially abuts against the body and one or more open positions, wherein the first support arm is configured to engage a first location of the boat in at least one of the open positions; and a second support arm which pivots about a second hinge proximate to the second body end, the second support arm pivoting independently of the first support arm between a closed position wherein the second support arm substantially abuts against the body and one or more open positions, wherein the second support arm is configured to engage a second location of the boat in at least one of the open positions.

2. The personal kayak carrying apparatus of claim 1, wherein the first support arm comprises a first support bracket configured to engage the first location of the kayak and the second support arm comprises a second support bracket configured to engage the second location of the kayak.

3. The personal kayak carrying apparatus of claim 2, wherein the first location of the kayak and the second location of the kayak are on a gunwale of a cockpit of the kayak.

4. The personal kayak carrying apparatus of claim 2, wherein the first support bracket swivels about its point of attachment with the first support arm or the second support bracket swivels about its point of attachment with the second support arm.

5. The personal kayak carrying apparatus of claim 1, wherein the center portion of the body is curved.

6. The personal kayak carrying apparatus of claim 1, further comprising a strap having a first strap end connected to the body proximate the first body end and a second strap end opposite the first strap end, the second strap end connected to the body proximate the second body end, the strap configured to help secure the kayak on the first support arm and the second support arm.

7. The personal kayak carrying apparatus of claim 1, wherein the body comprises padding configured to cushion the body against the user.

8. A personal boat carrying apparatus for supporting a boat on a user, the boat carrying apparatus comprising:

a body having a first body end, a second body end opposite the first body end, and a center portion between the first body end and the second body end, the center portion configured to rest on the user;

a first support disposed proximate to the first body end, the first support configurable in an open position to engage a first location of the boat and a closed position wherein the first support substantially abuts against the body; and a second support disposed proximate to the second body end, the second support configurable, independently of the first support, in an open position to engage a second location of the boat and a closed position wherein the second support substantially abuts against the body.

9. The personal boat carrying apparatus of claim 8, wherein the first support pivots between a closed position and one or more open positions about a first hinge proximate to the first body end and wherein the second support pivots between a closed position and one or more open positions about a second hinge proximate to the second body end.

10. The personal boat carrying apparatus of claim 9, wherein the first support comprises a first bracket configured to engage the first location of the boat and the second support comprises a second bracket configured to engage the second location of the boat.

11. The personal boat carrying apparatus of claim 10, wherein the first location of the boat and the second location of the boat are on a gunwale of the boat.

12. The personal boat carrying apparatus of claim 8, wherein the center portion is curved.

13. The personal boat carrying apparatus of claim 8, further comprising a strap having a first strap end connected to the body proximate the first body end and a second strap end opposite the first strap end, the second strap end connected to the body proximate the second body end, the strap configured to help secure the boat on the first support and the second support.

14. The personal boat carrying apparatus of claim 13, wherein the strap is adjustable.

15. The personal boat carrying apparatus of claim 14, wherein the strap includes a buckle disposed between the first strap end and the second strap end, the buckle for adjusting a length of the strap.

16. The personal boat carrying apparatus of claim 13, wherein the strap comprises nylon.

17. The personal boat carrying apparatus of claim 8, wherein the body comprises padding configured to cushion the body against the user.

18. A method of carrying a boat, the method comprising:

opening a first support of a personal boat carrying apparatus from a closed position wherein the first support substantially abuts against a body of the personal boat carrying apparatus in the closed position;

after the first support is opened, opening a second support of the personal boat carrying apparatus from a closed position wherein the second support substantially abuts against the body of the personal boat carrying apparatus in the closed position;

engaging a first location of the boat using the first support;

engaging a second location of the boat using the second support, wherein the first support and the second support are disposed at opposite ends of the body of the personal boat carrying apparatus; and resting a center portion of the body on a person, such that the person can carry the boat.

19. The method of claim 18, wherein the step of engaging a first location of the boat using a first support further comprises pivoting the first support from a closed position to an open position to engage the first position of the boat, wherein the step of engaging a second location of the boat using a second support comprises pivoting the second support from a closed position to an open position to engage the second location of the boat.

20. The method of claim 19, further comprising the step of securing a strap affixed to the body of the apparatus around the boat.

* * * * *